United States Patent [19]

Forsell

[11] Patent Number: 4,511,774

[45] Date of Patent: Apr. 16, 1985

[54] CURRENT LIMITING CONTACT ARRANGEMENT

[75] Inventor: Kenneth A. Forsell, Port Washington, Wis.

[73] Assignee: Eaton Corporation, Cleveland, Ohio

[21] Appl. No.: 559,503

[22] Filed: Dec. 8, 1983

[51] Int. Cl.[3] ..... H01H 33/20; H01H 33/16

[52] U.S. Cl. ..... 200/147 R; 200/144 AP; 335/16; 335/195

[58] Field of Search ..... 200/147 R, 144 AP; 335/16, 195

[56] References Cited

U.S. PATENT DOCUMENTS

| | | | |
|---|---|---|---|
| 3,092,699 | 6/1963 | Latour | 200/147 R |
| 3,555,471 | 1/1971 | Mitskevich et al. | 200/147 R |
| 3,728,505 | 4/1973 | McConnell | 200/144 AP |
| 3,943,473 | 3/1976 | Khalid | 335/16 |
| 4,237,355 | 12/1980 | Fechant et al. | 200/147 R |
| 4,430,631 | 2/1984 | Forsell et al. | 200/147 R |
| 4,451,718 | 5/1984 | Yamagata et al. | 200/147 R |

*Primary Examiner*—Robert S. Macon

*Attorney, Agent, or Firm*—C. H. Grace; L. G. Vande Zande

[57] ABSTRACT

Current limiting stationary (2) and movable (6) contacts are arranged to provide spaced, parallel oppositely directed current paths therein whereby fault currents generate electromagnetic forces for repelling the movable contact (6) from the stationary contact (2). An electrically resistive arc runner (20) has an arc transfer segment (20*a*) disposed along the path of movement of the movable contact (6) and is biased at one end (20*b*) into current carrying engagement with a stop (22) on stationary contact (2). The other end of the transfer segment (20*a*) is connected through a major length of the arc runner (20) to the stationary contact (2) at a point distinct from stop (22). An arc drawn between the contacts (2, 6) at separation initially passes current to the transfer segment (20*a*) and the stationary contact (2) through stop (22). Gas pressure from the arc subsequently forces a separation of the arc runner end (20*b*) from the stop (22) whereby current is directed through the major length of the arc runner to the stationary contact for increasing the resistance of the arc for extinguishing the arc.

10 Claims, 5 Drawing Figures

Fig. 3
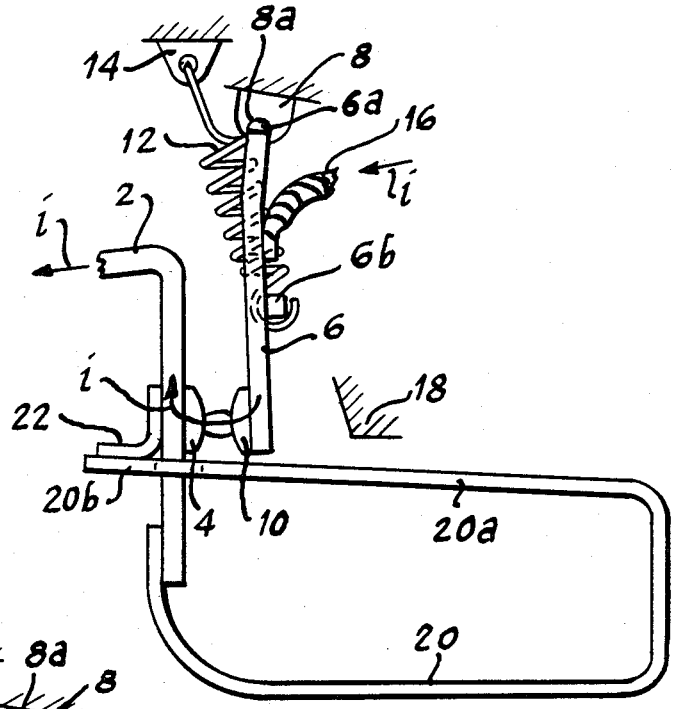
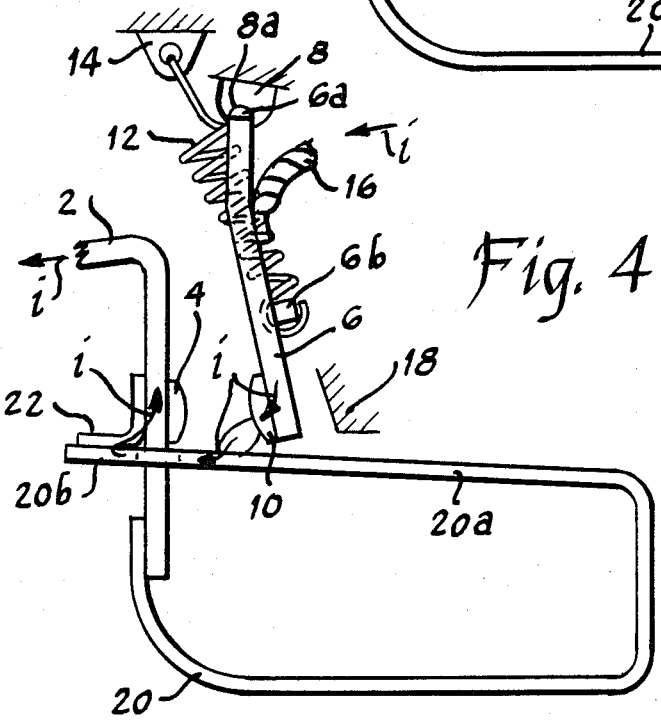
Fig. 4

CURRENT LIMITING CONTACT ARRANGEMENT

BACKGROUND OF THE INVENTION

This invention relates to electric circuit making and breaking contact arrangements of the current limiting type. More specifically, the invention relates to a current limiting contact arrangement which incorporates an arc transfer structure for assisting interruption of the electrical arc. The contact arrangement of this invention is particularly well suited for use in electric circuit breakers of the type which afford overcurrent protection.

Electric circuit breakers of the aforemention type comprise separable contacts which may be selectively operated between open and closed positions by a manual operator. In addition, such circuit breakers comprise current sensing structures which operate thermal and magnetic trip mechanisms to automatically trip the contacts open upon sensing currents that are in excess of predetermined amounts. The thermal sensing apparatus operates to trip the contacts open upon sensing currents which exceed a predetermined value by a first magnitude whereas the magnetic sensing means operates to trip the contacts open upon sensing currents in excess of a predetermined value of a second, greater magnitude. Increased current levels being made available by electric utility companies have introduced a still greater third magnitude of overcurrents which the electric circuit breaker is required to interrupt to provide the desired protection to the branch circuit and electric apparatus connected to that branch circuit. To interrupt currents which exceed the predetermined value by such third magnitude, circuit breaker designs incorporate current limiting contacts which generally comprise a pair of contacts and contact supports arranged to provide oppositely directed spaced parallel current paths whereby high currents generate repelling electromagnetic forces between the two contact structures to force the contacts apart independently of the thermal or magnetic trip mechanism. Such current limiting contact separation occurs faster than the magnetic trip structure can respond and causes the contacts to separate with great speed. A resulting electrical arc drawn between the contacts can sustain current flow and it is therefore also important to rapidly extinguish or break the arc. This invention relates to current limiting contact structures having improved arc extinguishing capabilities.

SUMMARY OF THE INVENTION

This invention provides a current limiting contact arrangement wherein stationary and movable contact members are arranged to have spaced parallel oppositely directed current paths for generating electromagnetic repulsion forces between the contact members upon the occurrence of fault currents in the contact members to cause separation of the contacts as a direct result of the fault currents therein, and an arc runner disposed adjacent the movable one of the contact members and electrically connected through normally closed contacts to the stationary one of said contact members for directing a resulting arc drawn between the separating contacts away from the stationary contact and onto the arc runner whereby a current path exists from the movable contact member through the electric arc, the arc runner, and the normally closed contacts to the stationary contact member and wherein pressure from the gases produced by the arc cause the normally closed contacts to open, thereby to interrupt the current flow to the stationary contact member. The arc runner is formed as a loop of electrical resistance material and is connected at one end to the stationary contact member through the normally closed contacts and is connected at its other end to the stationary contact at a point which is distinct from the connection thereto by the first end wherein current flow from the movable contact member through the electric arc to the arc runner is redirected through a major length of the loop of the arc runner when the normally closed contacts are open to provide a high resistance path for the current flow to the stationary contacts, thereby to increase the resistance of the electric arc for extinguishing the arc.

The invention and its advantages will be more readily understood in the accompanying description and claims when read in conjunction with the accompanying drawings.

BRIEF DESCRIPTION OF THE DRAWINGS

FIGS. 3–5 are side elevational views similar to FIG. 1 showing sequentially the operation of the contact arrangement.

DISCLOSURE OF THE PREFERRED EMBODIMENT

Figure 1:
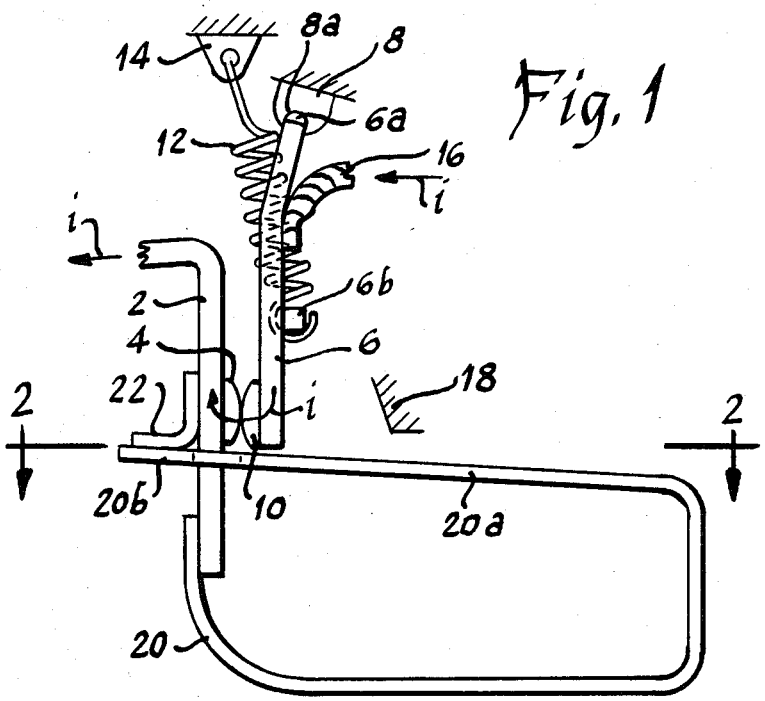
FIG. 1 is a side elevational view of a current limiting contact arrangement constructed in accordance with this invention and showing the contacts in a closed, circuit making position.
Figure 2:
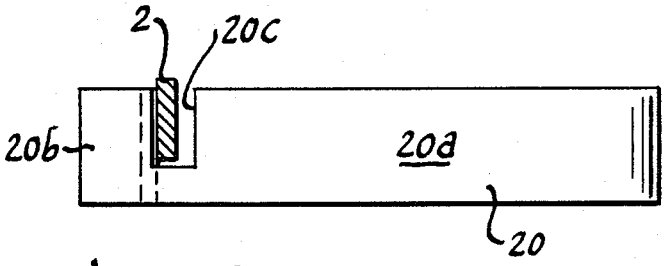
FIG. 2 is a cross sectional view taken along the line 2—2 of FIG. 1 showing an arc runner of the contact arrangement of FIG. 1 in top plan view.

The current limiting contact arrangement of this invention is particularly well suited to be utilized in a circuit breaker such as that disclosed and claimed in U.S. patent application Ser. No. 376,801 filed May 10, 1982 by K. A. Forsell et al, allowed Oct. 3, 1983, and assigned to the assignee of this invention, the disclosure of which is hereby incorporated by reference in this application. The contact arrangement comprises a stationary contact member 2 which has a stationary contact element 4 attached thereto approximately midway along a straight vertically oriented length of the member 2. A movable contact member 6 is pivotally supported at an upper end by a pair of forwardly and rearwardly projecting half cylindrical ears 6*a* which are received within recesses 8*a* of a pivot support member 8. The recesses 8*a* are substantially circular and formed complementally to the cylindrical radius of ears 6*a*, and have a narrow opening at the bottom thereof to enable the ears 6*a* to be inserted in their narrow dimension through the opening in the recesses 8*a* and the movable contact member 6 to be subsequently pivoted to its operating position whereby the ears are retained within the openings 8*a*. A movable contact element 10 is affixed to the movable contact member 6 adjacent the lower end thereof. The movable contact member may preferably be a U-shaped member with the ears 6*a* located at the upper, free ends of the legs thereof and the contact element 10 attached to the bight portion. A hook 6*b* is offset from one of the legs to project into the area between the legs. A helical spring 12 is connected in tension between the hook 6*b* and an anchor point 14 to provide a clockwise bias to the movable contact member 6 for biasing that member and contact element 10 into engagement with stationary contact element 4 of stationary contact member 2. A flexible braid conductor 16 is attached to one leg of the movable contact member 6 for connecting the movable contact member in an electrical circuit.

When the contact arrangement of FIG. 1 is incorporated into a circuit breaker such as that disclosed in the above referenced patent application, the anchor 14 is preferably a latch lever of the circuit breaker and the pivot support 8 is preferably formed on a manually pivotable operating handle for the circuit breaker wherein the movable contact 6 may be caused to operate between open and closed contact positions by operation of the handle or by release of the latch lever through current sensing trip means in a manner which is well known in the circuit breaker art. However, for purposes of this invention, it is necessary only to consider the movement of movable contact member 6 under current limiting operation in which case the pivot support 8 and the anchor 14 assume fixed positions within a circuit breaker and are so illustrated in the drawings. In a circuit breaker embodiment the flexible conductor 16 and the stationary contact member 2 may be assumed to be attached to suitable electrical connector means for connection in an electrical circuit wherein current will flow through the elements in the direction indicated by the arrows identified as i. It should be recognized that the direction of current flow is a conventional representation for purposes of description inasmuch as AC applications of the contact arrangement will have current flow in the opposite direction as well.

When the aforedescribed contact arrangement is connected in an operative circuit, current may be described as flowing through the flexible conductor 16, movable contact member 6, movable contact element 10, stationary contact element 4, and stationary contact member 2. Current flowing in the movable contact member 6 between the point of connection of flexible conductor 16 and the movable contact element 10 is directed downwardly and parallel to the current flowing in stationary contact member 2 between the stationary contact element 4 and the uppermost end of stationary contact member 2 to provide spaced, parallel, and oppositely directed current paths. When a fault current such as a short circuit current exists in the contact members, the current in each contact member generates electromagnetic forces around the respective contact member which react to repel the contact members 6 and 2 away from each other. Inasmuch as contact member 2 is a stationary member, these forces act to drive the movable contact member 6 in a counterclockwise direction about the pivot support 8, thereby separating the contact elements 10 and 4. A fixed stop member 18 is provided to arrest the opening movement of movable contact member 6.

When high magnitude currents such as the fault currents which cause current limiting operation of the contact arrangement are separated, an electric arc is established between the separating contacts. This arc sustains current flow until it is interrupted or extinguished. The principle of the current limiting operation of the contact arrangement is to separate the contacts extremely rapidly and to quickly stretch or lengthen the arc to increase its resistance and voltage to thereby extinguish the arc. Other means, such as arc splitter plates and arc runners are also employed in conjunction with current limiting contacts to assist in extinguishing the arc. However, electric arcs resist being lengthened, split or moved to an area where their resistance increases. The contact arrangement of this invention utilizes this concept for redirecting the arc away from the stationary contact and onto an arc runner, a high resistance material to substantially increase the resistance of the arc for extinguishing the same.

An arc runner 20 formed of electrical resistor material is electrically attached, such as by welding or the like, at one end to the lower end of stationary contact member 2. Arc runner 20 is formed into a loop wherein an upper leg 20*a* is disposed adjacent the path of movement of movable contact member 6 to serve as an arc transfer segment for the arc runner 20. The other end 20*b* of arc runner 20 is notched at 20*c* to extend around stationary contact member 2. The arc runner 20 is formed to have a resilient bias of upper leg arc transfer segment 20*a* in the upward direction. A stop member 22 is affixed to stationary contact member 2 at the side thereof opposite stationary contact element 4 to be abutted by end 20*b* of the arc runner, thereby to serve as a fixed stop member for the upper leg of the arc runner 20. End 20*b* and stop member 22 also serve as normally closed current carrying contacts for conducting current from arc runner 20 to stationary contact member 2.

Figure 5:
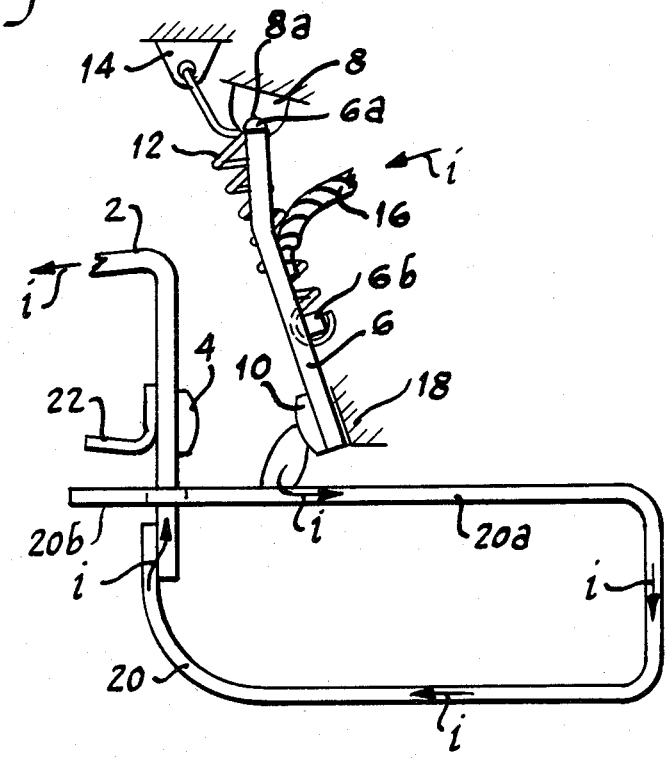

Referring now to FIGS. 3–5, current limiting separation of movable contact member 6 from stationary contact member 2 under high fault current conditions may be seen in FIG. 3 to establish an arc between the movable contact element 10 and the stationary contact element 4. As mentioned hereinbefore, the arc sustains current flow therethrough and therefore, fault current continues to flow to stationary contact 2. Continued movement of movable contact member 6 counterclockwise to the right causes the arc to be lengthened and its tendency to resist such lengthening and the proximity of the arc transfer segment 20*a* to the end of movable contact member 6 causes the arc to be directed away from the stationary contact element 4 and onto the transfer segment 20*a* of the arc runner as seen in FIG. 4. This transfer of the arc is facilitated because a current path may exist from the movable contact member 6, its element 10, and through the arc onto the arc runner 20 and directly to the stationary contact member 2 through the closed contacts 20*b* and 22. This introduces little additional resistance to the current path and to the arc. As seen in FIG. 5, continued movement of the movable contact member 6 counterclockwise to the right brings it into engagement with a stop 18. During this continued movement, the arc remains between the movable contact element 10 and the arc transfer segment 20*a* because little lengthening of the arc or increase in the resistance of the arc runner between the arc and the end 20*b* occurs. However, the arc produces gases which, in a confined space, have pressure associated therewith, and the forces associated with the arc gas pressure act upon the flexible upper arc transfer segment 20*a* of arc runner 20 to force it downwardly causing the end 20*b* to move away from the stop 22 and thereby opening the normally closed contacts to interrupt the current path to stationary contact member 2 through stop 22. Such interruption causes the arc current to be directed oppositely in the arc runner through the major portion of the loop of the arc runner and to be directed into the stationary contact 2 at the lower end thereof. The significantly increased resistive path for the current increases the resistance and the voltage of the arc to extinguish the same, thereby fully interrupting the current flow sustained by the arc.

While the current limiting contact arrangement disclosed herein represents a preferred form of the invention, it is to be understood that it is susceptible to various modifications without departing from the scope of the appended claims.

I claim:

1. A current limiting contact arrangement comprising, in combination:

stationary and movable contact means providing spaced parallel oppositely directed current paths therein, said movable contact means being biased for engagement with said stationary contact means and being separable therefrom by electromagnetic repulsion forces established by fault currents in said stationary and movable contact means; and an arc runner having a first end electrically connected to said stationary contact means through normally closed contact means, a transfer segment adjacent said first end extending along a path of movement of said movable contact means, and a continuing portion extending from said transfer segment to a second end which is electrically connected to said stationary contact means at a point distinct from said connection of said first end thereto;

wherein initial separating movement of said movable contact means from said stationary contact means establishes an electric arc therebetween, said arc being directed from said movable contact means away from said stationary contact means onto said transfer segment during continued separating movement of said movable contact means for establishing an arc current path from said movable contact means through said transfer segment and said normally closed contact means to said stationary contact means, and wherein forces associated with gases produced by said arc effect opening of said normally closed contact means for interrupting said arc current path therethrough and redirecting said arc current path through said transfer segment and said continuing portion to said stationary contact means for increasing the resistance of said arc current path and the voltage of said arc.

2. The invention defined in claim 1 wherein said arc runner comprises one contact of said normally closed contact means.

3. The invention defined in claim 2 wherein means are provided on said stationary contact means for engagement by said arc runner, said means comprising another contact of said normally closed contact means.

4. The invention defined in claim 2 wherein said arc runner transfer segment is resiliently biased for engagement with means on said stationary contact means, said first end of said arc runner and said means on said stationary contact means comprising said normally closed contact means.

5. The invention defined in claim 4 wherein said means on said stationary contact means comprises stop means located on an opposite side of said stationary contact means from said movable contact means, and said first end of said arc runner extends around said stationary contact means for engagement with said stop means.

6. The invention defined in claim 4 wherein arc runner transfer segment is resiliently biased toward said movable contact means in a direction normal to the separating movement of said movable contact means.

7. The invention defined in claim 4 wherein said arc runner is a unitary member with said transfer segment formed as a cantilever supported at said continuing portion and integrally biased toward said movable contact means in a direction normal to the separating movement of said movable contact means.

8. The invention defined in claim 1 wherein said arc runner comprises an electrical resistance material.

9. The invention defined in claim 8 wherein said continuing portion forms an elongated loop from said transfer segment to said second end for providing a substantial length of resistance material in said arc current path.

10. The invention defined in claim 1 wherein said second end of said arc runner is directly attached to said stationary contact means.

* * * * *